US008538046B2

(12) United States Patent
Chen

(10) Patent No.: US 8,538,046 B2
(45) Date of Patent: Sep. 17, 2013

(54) SPEAKER SET AND ELECTRONIC DEVICE INCORPORATING THE SAME

(75) Inventor: Hwang-Miaw Chen, Taipei Hsien (TW)

(73) Assignee: Foxconn Technology Co., Ltd., New Taipei (TW)

( * ) Notice: Subject to any disclaimer, the term of this patent is extended or adjusted under 35 U.S.C. 154(b) by 899 days.

(21) Appl. No.: 12/612,665

(22) Filed: Nov. 4, 2009

(65) Prior Publication Data

US 2010/0246873 A1 Sep. 30, 2010

(30) Foreign Application Priority Data

Mar. 30, 2009 (CN) ..... 2009 1 0301217

(51) Int. Cl.
*H04R 25/00* (2006.01)
*H04R 9/06* (2006.01)

(52) U.S. Cl.
USPC ..... 381/182; 381/333

(58) Field of Classification Search
USPC ..... 381/333, 182
See application file for complete search history.

(56) References Cited

U.S. PATENT DOCUMENTS

| | | | | |
|---|---|---|---|---|
| 4,031,318 | A * | 6/1977 | Pitre | 381/386 |
| 4,790,020 | A * | 12/1988 | Lin | 381/351 |
| 6,801,631 | B1 * | 10/2004 | North | 381/336 |
| 2006/0126879 | A1 * | 6/2006 | Kuo | 381/354 |
| 2006/0151237 | A1 * | 7/2006 | Oxford et al. | 181/199 |
| 2006/0182298 | A1 * | 8/2006 | Stiles et al. | 381/335 |

* cited by examiner

*Primary Examiner* — Duc Nguyen
*Assistant Examiner* — George Monikang
(74) *Attorney, Agent, or Firm* — Altis Law Group, Inc.

(57) ABSTRACT

An electronic device includes an enclosure and a speaker set received in the enclosure. The speaker set includes a shell, a pair of first and second speakers received in the shell. The first speakers provide high frequency acoustic output, and the second speakers provide low and middle frequency acoustic output. The shell includes a fixing plate. The fixing plate defines two tweet outlets aligning respectively with the first speakers, and two middle woof outlets aligning respectively with the second speakers. A central point of each middle woof outlet is located nearer to an imaginary central line of the fixing plate than a central point of each tweet outlet. A portion of each of the middle woof outlets is shaded by a portion of the electronic device. The tweet outlets are located beside the portion of the electronic device but not shaded by the portion.

19 Claims, 14 Drawing Sheets

SPEAKER SET AND ELECTRONIC DEVICE INCORPORATING THE SAME

BACKGROUND

1. Technical Field

The disclosure generally relates to speaker sets, and particularly to a speaker set used in an electronic device.

2. Description of Related Art

With the continuing development of audio and sound technology, speaker sets have been widely used in electronic devices such as mobile phones, computers, televisions and other devices providing audio capabilities.

Nowadays, small sized electronic devices are very popular. In such electronic devices, the shape, location and bulk of speaker sets are limited to some extent. Areas around speakers in the speaker sets are commonly cluttered with other components of the electronic device. It is well known that a high frequency range of sound output by speakers has a sensitive directionality. In other words, the high frequency range of sound is particularly susceptible to attenuation when the area in front of a speaker is even partially blocked by components. This results in increased distortion of the sound, and the quality of the sound output by the speaker set is reduced. Therefore, the design of speaker sets is limited not only by the small confines available to accommodate the speakers themselves, but also by the lack of free space around such confines. It is problematic to provide speaker sets that provide high quality output sound.

What is needed, therefore, is a speaker set and an electronic device incorporating the speaker set which can overcome the described limitations.

BRIEF DESCRIPTION OF THE DRAWINGS

Many aspects of the present speaker set and electronic device incorporating the speaker set can be better understood with reference to the following drawings. The components in the drawings are not necessarily drawn to scale, the emphasis instead being placed upon clearly illustrating the principles of the present speaker set and electronic device incorporating the speaker set. Moreover, in the drawings, like reference numerals designate corresponding parts throughout the several views.

DETAILED DESCRIPTION

Figure 1:
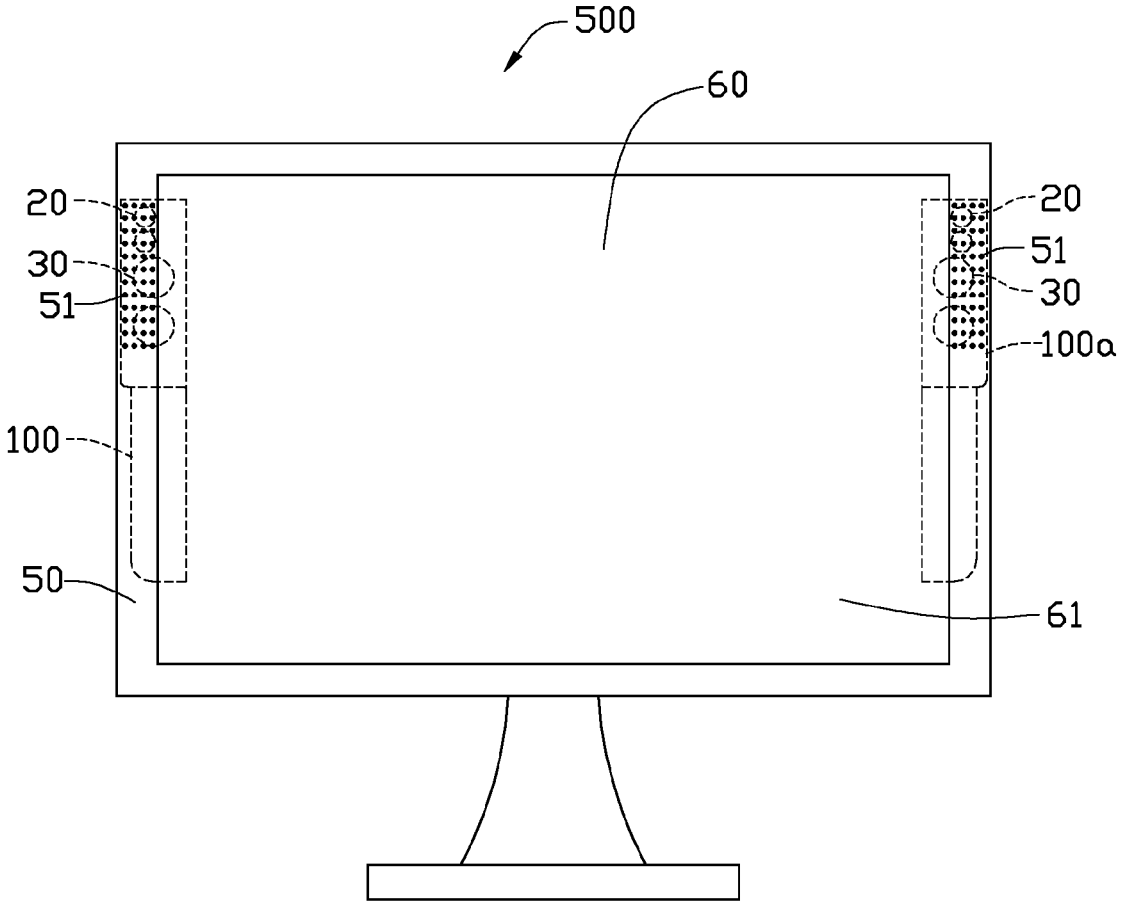
FIG. 1 is a schematic view of an electronic device incorporating first and second speaker sets in accordance with a first embodiment of the disclosure.

Referring to FIG. 1, an electronic device 500 incorporating a first speaker set 100 and a second speaker set 100*a* is shown. In this embodiment, the electronic device 500 is a display device. Alternatively, the electronic device 500 can be a mobile phone, a television, and so on. The electronic device 500 includes an enclosure 50 and a screen 60 fixed on the enclosure 50. The enclosure 50 defines a plurality of tiny through holes 51 at left and right edges of a front side (or bezel) thereof. The screen 60 is located at a middle of the enclosure 50, and includes a glass plate 61 at a front side thereof. The speaker sets 100, 100*a* are received in the enclosure 50, and are symmetrically positioned at left and right sides of the screen 60. The speaker sets 100, 100*a* are generally the same as each other, albeit symmetrical to each other.

Figure 2:
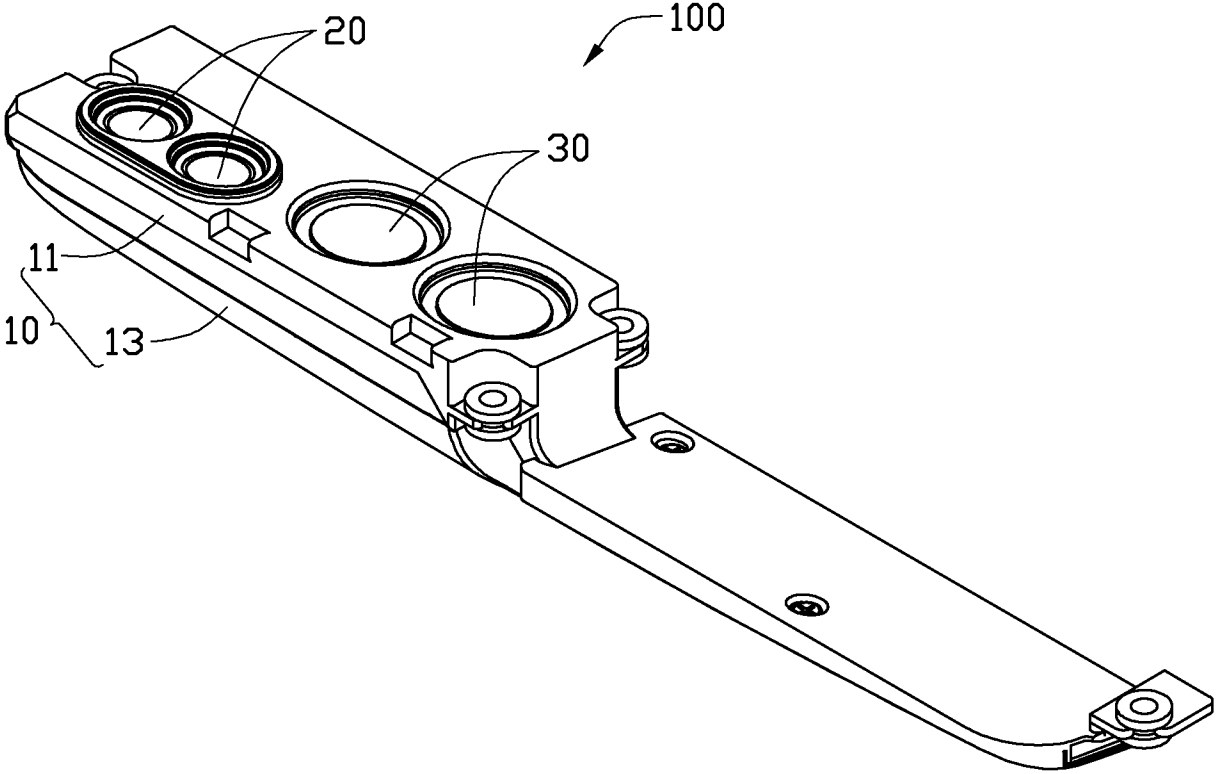
FIG. 2 is an enlarged, isometric view of the first speaker set of FIG. 1.
Figure 6:
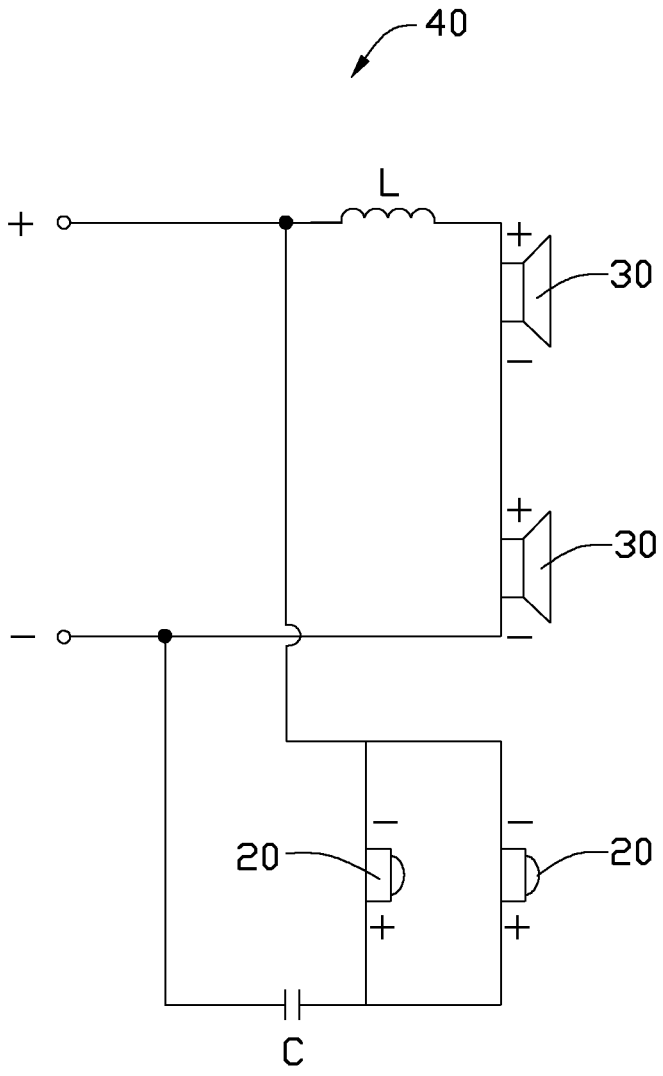
FIG. 6 is a diagram of a frequency dividing circuit of the first speaker set of FIG. 2.

Referring also to FIG. 2, the first speaker set 100 includes a shell 10, a pair of tweeters 20, a pair of middle woofers 30 and a frequency dividing circuit 40 (shown in FIG. 6). The shell 10 is made of plastic, and includes a top cover 11 and a bottom cover 13 joined with the top cover 11.

Figure 3:
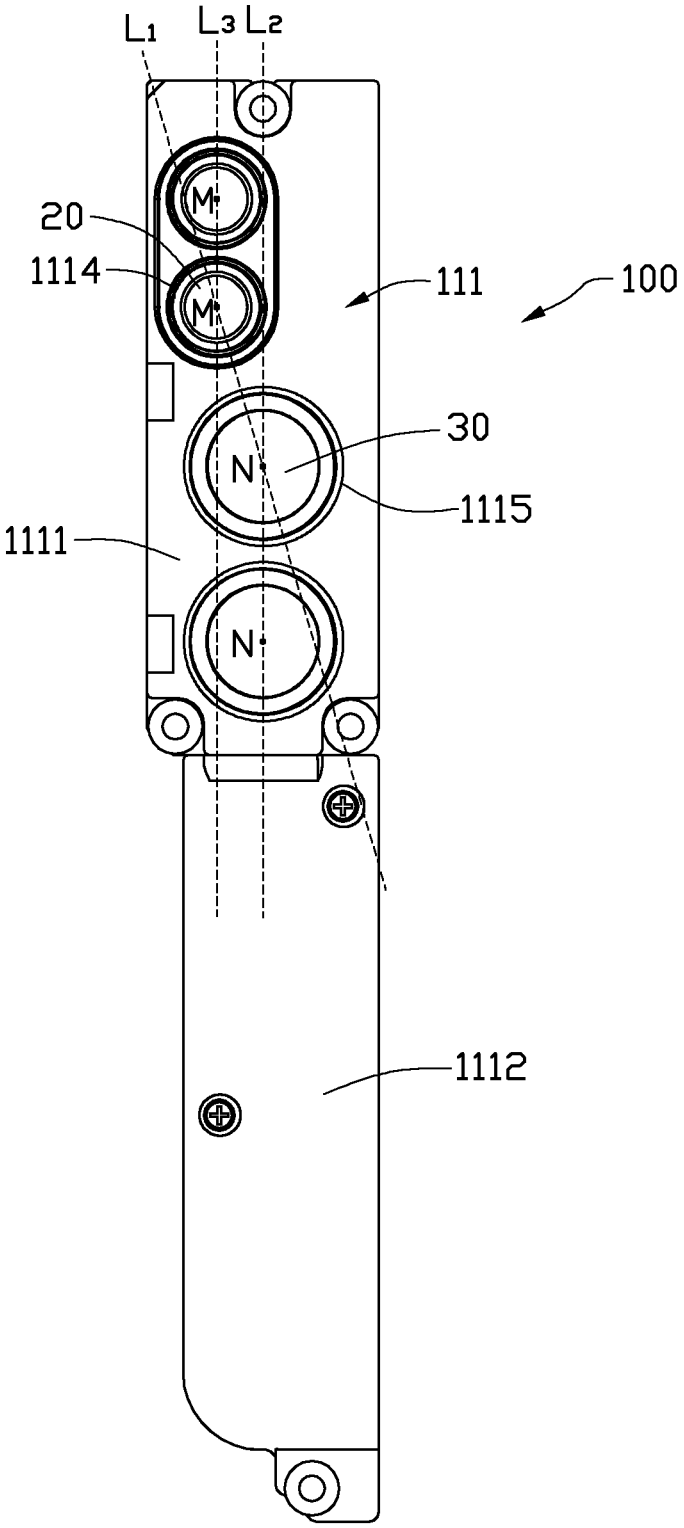
FIG. 3 is a top plan view of the first speaker set of FIG. 2.
Figure 4:
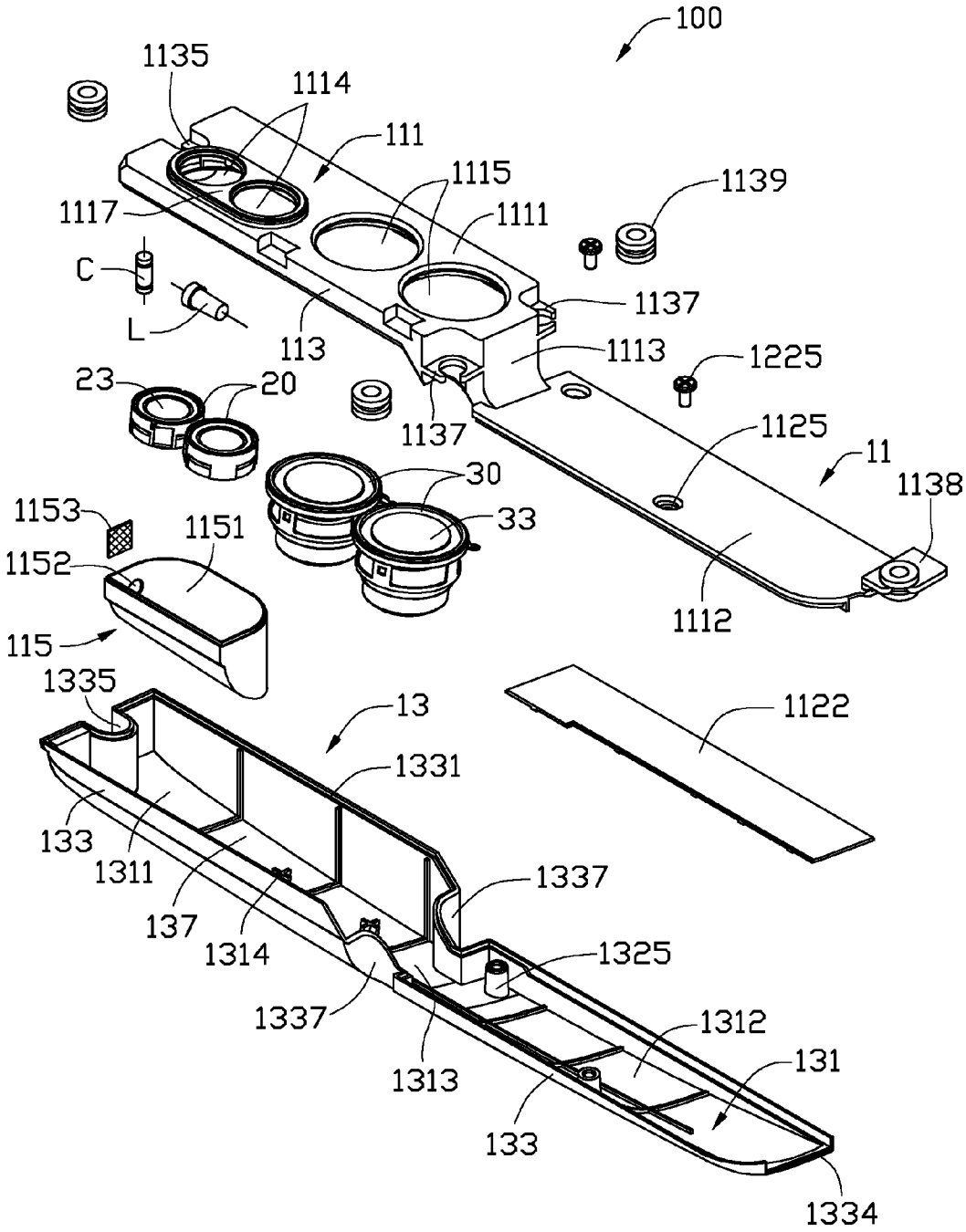
FIG. 4 is an exploded view of the first speaker set of FIG. 2.
Figure 5:
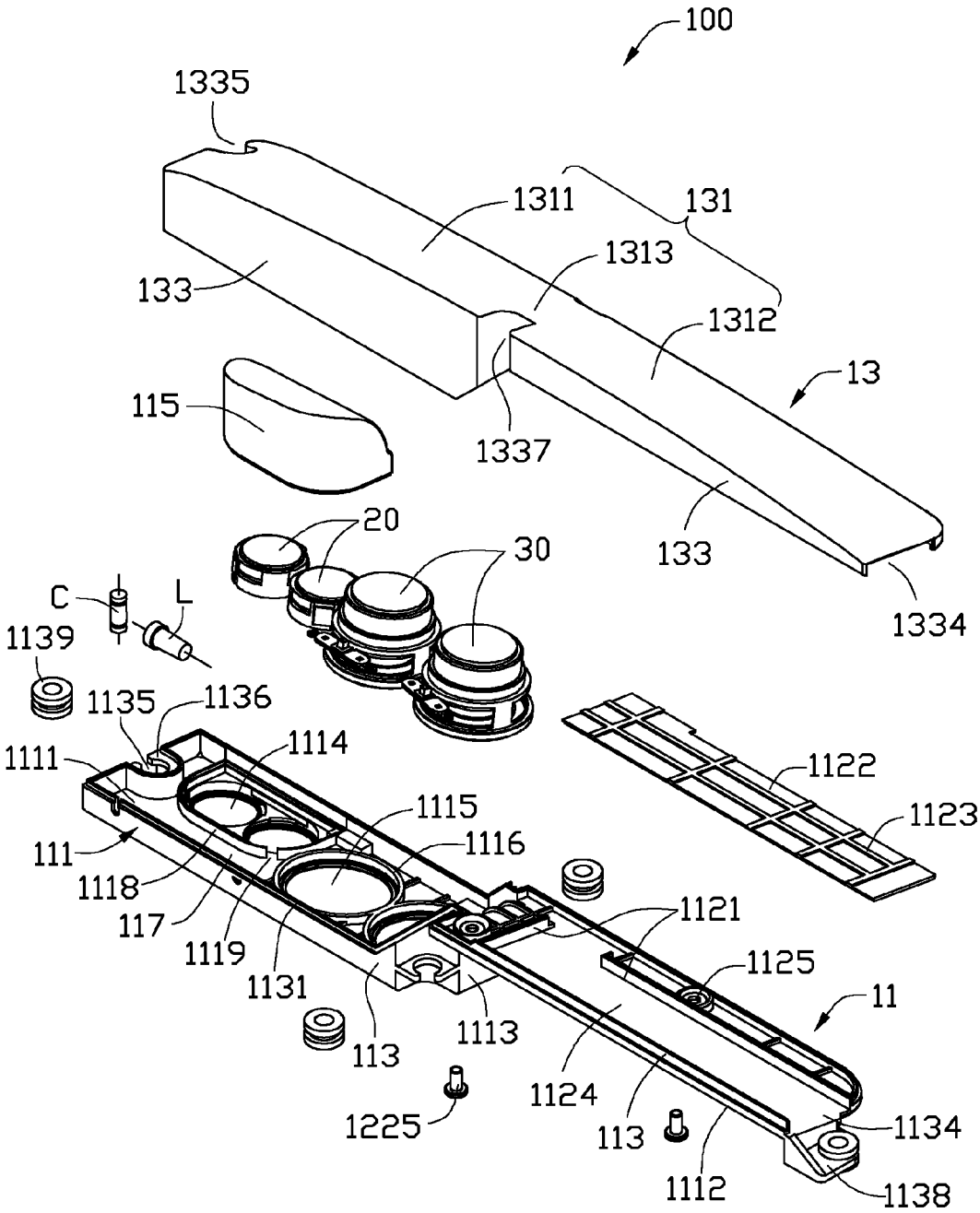
FIG. 5 is similar to FIG. 4, but viewed from another aspect.

Referring to FIGS. 3 to 5, both of the top and bottom covers 11, 13 are semi-enclosed. The top cover 11 includes a mounting wall 111, a sidewall 113 extending vertically from an outer periphery of the mounting wall 111 to the bottom cover 13, and a sound cover 115 attached to the mounting wall 111. The mounting wall 111 and the sidewall 113 cooperatively define a semi-enclosed resonance chamber 117 therebetween. The mounting wall 111 includes a fixing plate 1111 at a rear end thereof, an extension plate 1112 at a front end thereof, and a connecting plate 1113 connecting the fixing plate 1111 with the extension plate 1112. Both of the fixing plate 1111 and the extension plate 1112 are substantially rectangular and planar. The fixing plate 1111 and the extension plate 1112 have a height difference. The connecting plate 1113 extends vertically and downwardly from a front end of the fixing plate 1111 (as viewed in FIG. 4), and smoothly connects to a rear end of the extension plate 1112, whereby the mounting wall 111 forms a step shape.

The fixing plate 1111 defines a central line $L_2$ extending from front to rear. In the illustrated embodiment, the central line $L_2$ runs along the exact middle of the mounting wall 111. The fixing plate 1111 defines a pair of tweet outlets 1114 and a pair of middle woof outlets 1115 therethrough. The tweet and middle woof outlets 1114, 1115 are arranged along the central line $L_2$. All of the tweet and middle woof outlets 1114, 1115 are circular, and each tweet outlet 1114 has a diameter less than that of each middle woof outlet 1115. A central point N of each middle woof outlet 1115 is located nearer to the central line $L_2$ of the fixing plate 1111 than a central point M of each tweet outlet 1114. In the illustrated embodiments, the central point N of each middle woof outlet 1115 is located on the central line $L_2$ of the fixing plate 1111. The pair of tweeters 20 are respectively mounted in the pair of tweet outlets 1114, and the pair of middle woofers 30 are respectively mounted in the pair of middle woof outlets 1115. The tweet outlets 1114 are located at a rear end of the fixing plate 1111, adjacent to a corresponding long side of the fixing plate 1111. The middle woof outlets 1115 are located at a middle of a front end of the fixing plate 1111, adjacent to the connecting plate 1113. A line $L_1$ is defined through the central point M of any one of the tweet outlets 1114 and the central point N of any one of the middle woof outlets 1115. The line $L_1$ and the central line $L_2$ of the fixing plate 1114 define an acute angle therebetween.

As shown in FIG. 3, in this embodiment, the tweet outlets 1114 are adjacent to each other, and the central points M of the tweet outlets 1114 are located at a left side of the central line $L_2$ of the fixing plate 1114. The middle woof outlets 1115 are also adjacent to each other, and the central line $L_2$ of the fixing plate 1111 extends through the central points N of the middle woof outlets 1115. A line $L_3$ is defined through the central points M of the tweet outlets 1114. The line $L_3$ is parallel to the central line $L_2$.

The fixing plate 1111 has a pair of rings 1116 extending vertically out toward the resonance chamber 117. The rings 1116 are disposed around the middle woof outlets 1115, respectively, so as to mount the middle woofers 30 thereat conveniently. A washer 1117 is disposed on an outer surface of the fixing plate 1111, around the tweet outlets 1114. The washer 1117 is made of elastic material, such as Ethylene Vinyl Acetate (EVA), and so on. The washer 1117 not only prevents sound leakage, but also reduces mechanical vibration between the speaker set 100 and the electronic device 500 incorporating the speaker set 100. The fixing plate 1111 has an annular outer wall 1118 extending vertically out toward the resonance chamber 117. The outer wall 1118 is disposed around the tweet outlets 1114. The outer wall 1118 defines a wire groove 1119 therein, so that wires (not shown) of the tweeters 20 can pass through the outer wall 1118.

A plurality of clapboards 1121 extend vertically from an inner surface of the extension plate 1112 toward the bottom cover 30. The clapboards 1121 are covered by a sheet 1122. The sheet 1122 forms a plurality of staggered ribs 1123 thereon, to improve the rigidity thereof. The sheet 1122, the clapboards 1121, the extension plate 1112 and the sidewall 113 neighboring the extension plate 1112 cooperatively define an L-shaped sound channel 1124 therebetween. The extension plate 1112 further defines a plurality of fixing holes 1125 therethrough beside the sound channel 1124.

The sidewall 113 of the top cover 11 forms a step 1131 at a bottom end thereof. An inner side of the step 1131 is lower than an outer side of the step 1131, so that the top cover 11 engages with the bottom cover 13 conveniently. The sidewall 113 defines a sound orifice 1134 at a front end of the extension plate 1112. The sound orifice 1134 communicates with the sound channel 1124. One portion of the sidewall 113 is sunken into the resonance chamber 117, defining a first fixing groove 1135 at the rear end of the fixing plate 1111. A first tab 1136 extends outwardly from the sidewall 113, within the fixing groove 1135. The sidewall 113 is slantwise at the connecting plate 1113 of the top cover 11. Two second tabs 1137 extend outwardly from the sidewall 113 at two sides of the connecting plate 1113, respectively, and a third tab 1138 extends outwardly from the sidewall 113 at the front end of the extension plate 1112. The first, second and third tabs 1136, 1137, 1138 are adapted for fixing the speaker set 100 onto the electronic device 500. In addition, a plurality of rubber bushings 1139 respectively enclose and cooperate with the first, second and third tabs 1136, 1137, 1138, further reducing mechanical vibration between the speaker set 100 and the electronic device 500.

The sound cover 115 is semi-enclosed, and engages with the outer wall 1118 of the fixing plate 1111 of the top cover 11 at an open end thereof to cooperatively define an enclosed receiving chamber 1151 therebetween. The tweeters 20 are received in the receiving chamber 1151, thereby preventing sound produced by the tweeters 20 and sound produced by the middle woofers 30 from interfering with each other. The sound cover 115 further defines a tuning hole 1152 therein, which is in communication with the receiving chamber 1151 and the resonance chamber 117. A tuning cloth 1153, which is made of unwoven cloth, is attached over the tuning hole 1152. The tuning cloth 1153 cooperates with the tuning hole 1152 to improve the sound quality factor and adjust the sound sharpness of the tweeters 20, whereby high frequency sound from the tweeters 20 links smoothly with middle and low frequency sound from the middle woofers 30.

The bottom cover 13 is similar to the top cover 11, also including a mounting wall 131 and a sidewall 133 extending vertically and upwardly from an outer periphery of the mounting wall 131. The mounting wall 131 and the sidewall 133 cooperatively define a semi-enclosed resonance chamber 137 therebetween. The mounting wall 131 is elongated and convex, and includes a fixing plate 1311 at a rear end thereof, an extension plate 1312 at a front end thereof, and a connecting plate 1313 connecting the fixing plate 1311 with the extension plate 1312. The fixing plate 1311, the extension plate 1312 and the connecting plate 1313 correspond to the fixing plate 1111, the extension plate 1112 and the connecting plate 1113 of the top cover 11, respectively. The fixing plate 1311, the extension plate 1312 and the connecting plate 1313 are arcuate along a widthwise direction of the mounting wall 131, and smoothly connect with each other along a lengthwise direction.

Two X-shaped brackets 1314 extend upwardly from the mounting wall 131, within the resonance chamber 137. The brackets 116 align with the middle woof outlets 1115, and are for supporting the middle woofers 30, respectively.

The extension plate 1312 has a pair of bolts 1325 extending out therefrom, corresponding to each of the fixing holes 1125.

The sidewall 133 of the bottom cover 13 forms a step 1331 at a top end thereof. An inner side of the step 1331 is higher than an outer side of the step 1331, so as to match with the step 1131 of the sidewall 113 of the top cover 11.

The sidewall 133 defines a sound orifice 1334 at a front end of the extension plate 1312. The sound orifice 1334 aligns with the sound orifice 1134 of the top cover 11. Three portions of the sidewall 113 are sunken into the resonance chamber 137, defining a first fixing groove 1335 at the rear end of the fixing plate 1311, and two second fixing grooves 1337 respectively at two sides of the connecting plate 1313. The first groove 1335 aligns with the first groove 1135 and the first tab 1136 of the top cover 11. The second fixing grooves 1337 align with the second tabs 1137 of the top cover 11, respectively. The sidewall 133 is also slantwise at the connecting plate 1313 of the bottom cover 13.

All of the tweeters 20 and the middle woofers 30 convert electric energy into vibration to produce sound. The tweeters 20 mainly provide high frequency acoustic output. Each of the tweeters 20 includes a diaphragm 23 at a top end thereof. The diaphragm 23 has a diameter substantially equal to that of each tweet outlet 1114. The middle woofers 30 mainly provide middle and low frequency acoustic output. Each of the middle woofers 30 has a diameter greater than that of each tweeter 20, and also includes a diaphragm 33 at a top end thereof. The diaphragm 33 has a diameter greater than that of the diaphragm 23 of each tweeter 20, and substantially equals to that of each middle woof outlet 1115.

Referring to FIG. 6, the frequency dividing circuit 40 is a dual-branch frequency circuit, and thus divides sound into two frequency ranges, i.e., middle and low frequency range, and a high frequency range. The frequency dividing circuit 40 includes a capacitance C and an inductance L. A high-pass branch circuit is formed via connecting the capacitance C in series with the tweeters 20 which are connected in parallel, to filter the middle and low frequency range of the sound to be output from the tweeters 20 as much as possible. A low-pass branch circuit is formed via connecting the inductance L in series with the middle woofers 30 which are connected in series, to filter the high frequency range of the sound to be output from the middle woofers 20 as much as possible. A crossover point of the frequency dividing circuit 40 is greater than or equal to two times a lowest resonance frequency of the tweeters 20, for gaining better high frequency signals.

Figure 7:
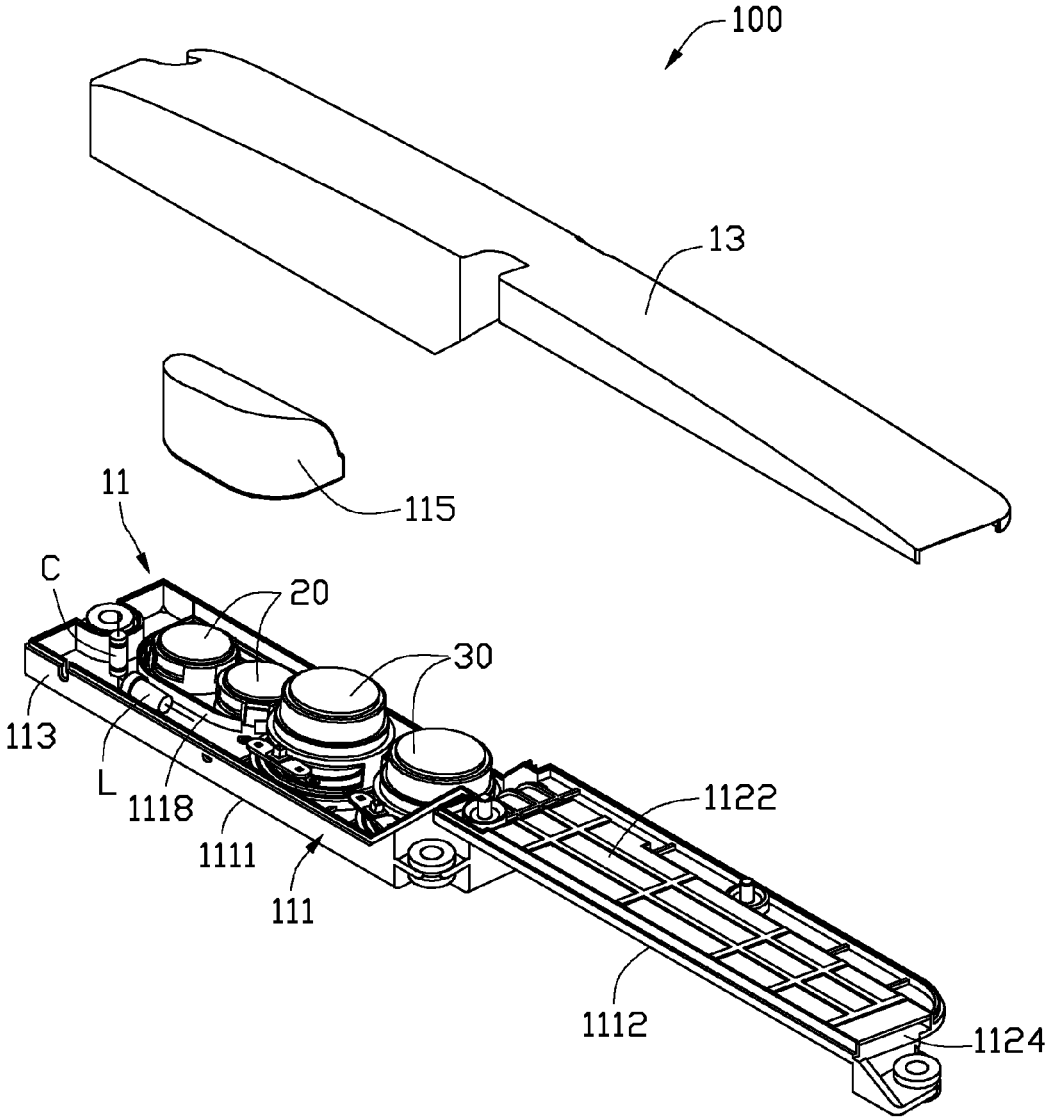
FIG. 7 is similar to FIG. 5, but showing the first speaker set partly assembled, with a bottom cover and a sound cover of the first speaker set still not assembled.

Referring to FIG. 7, during assembly of the speaker set 100, one end of each tweeter 20, with the corresponding diaphragm 23, is aligned with the corresponding tweet outlet 1114 of the fixing plate 1111 of the top cover 11, and engaged with the fixing plate 1111. One end of each middle woofer 30, with the corresponding diaphragm 33, is aligned with the corresponding middle woof outlet 1115 of the fixing plate 1111, and engaged with the fixing plate 1111. The tweeters 20 are electrically connected to the middle woofers 30 according to the configuration of the frequency dividing circuit 40.

The sound cover 115 is covered on the tweeters 20, with the tweeters 20 received in the receiving chamber 1151 of the sound cover 115. An edge of the sound cover 115 at the open end thereof is adhered intimately to the outer wall 1118 of the fixing plate 1111 of the top cover 11. The step 1131 of the sidewall 113 of the top cover 11 is engaged intimately with the step 1331 of the sidewall 133 of the bottom cover 13. At this time, the resonance chamber 117 of the top cover 11 and the resonance chamber 137 of the bottom cover 13 cooperatively form a consolidated resonance chamber. The tweeters 20 and the middle woofers 30 are received in the resonance chamber, and a rear end of each middle woofer 30 closely or contactingly abuts a corresponding bracket 1314 of the bottom cover 13. The sound orifice 1134 of the sidewall 113 of the top cover 11 and the sound orifice 1334 of the sidewall 133 of the bottom cover 13 align with each other, and further cooperatively form a consolidated sound orifice in communication with the sound channel 1124 and the outside. A plurality of screws 1225 are provided to extend through the fixing holes 1125 of the top cover 11 and be screwed into the bolts 1325 of the bottom cover 13, respectively. Thereby, the top and bottom covers 11, 13 are attached together.

During operation of the speaker set 100, the tweeters 20 and the middle woofers 30 produce sound forwardly and backwardly. The forward sound is directly transmitted out via the tweet and middle woof outlets 1114, 1115. The backward sound enters and resonates in the resonance chamber of the speaker set 100, and is then transmitted out via the sound channel 1124 and the sound orifice. The sound transmitted from the sound orifice and the sound transmitted from the tweet and middle woof outlets 1114, 1115 are combined, widening the frequency bandwidth of the sound output from the speaker set 100.

Figure 8:
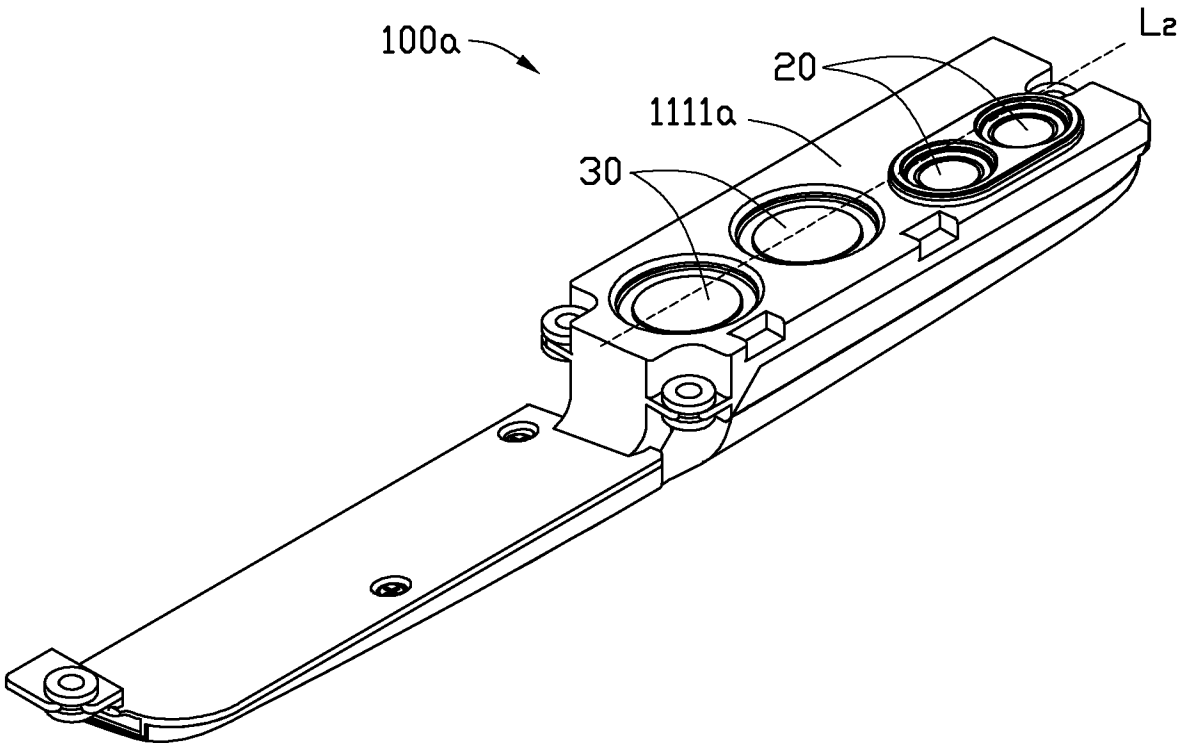
FIG. 8 is an enlarged, isometric view of the second speaker set of FIG. 1.

Referring to FIG. 8, the second speaker set 100*a* is completely symmetrical to the speaker set 100. The tweeters 20 of the second speaker set 100*a* are disposed at a right side of the central line $L_2$ of a fixing plate 1111*a*.

Referring to FIG. 1 again, the speaker sets 100, 100*a* are received in the enclosure 50, and are symmetrically positioned at the left and right sides of the screen 60. Portions of the middle woofers 30 and the middle woof outlets 1115 of each of the speaker sets 100, 100*a* are shaded by the glass plate 61 of the screen 60 (or other components in the electronic device 500), and other portions of the middle woofers 30 and the middle woof outlets 1115 are aligned with the through holes 51 of the enclosure 60. The tweeters 20 and the tweet outlets 1114 of the speaker sets 100, 100*a* are located beside the glass plate 61 of the screen 60. In other words, the tweeters 20 and the tweet outlets 1114 of the speaker sets 100, 100*a* are entirely aligned with the through holes 51 of the enclosure 60, and are not shaded by the glass plate 61 of the screen 60.

The middle and low frequency range of sound has a torpid directionality, and the high frequency range of sound has a sensitive directionality. Accordingly, in the present electronic device 500, even though portions of the middle woofers 30 are shaded by the glass plate 61, the middle and low frequency range of the sound output from the middle woofers 30 is essentially not impacted. However, since the tweeters 20 are located beside the glass plate 61, the high frequency range of the sound output from the tweeters 20 also is not impacted. Therefore, not only is any distortion of the output sound reduced, and a sound output quality of the electronic device 500 improved; but also the overall space occupied by the electronic device 500 is reduced.

Figure 9:
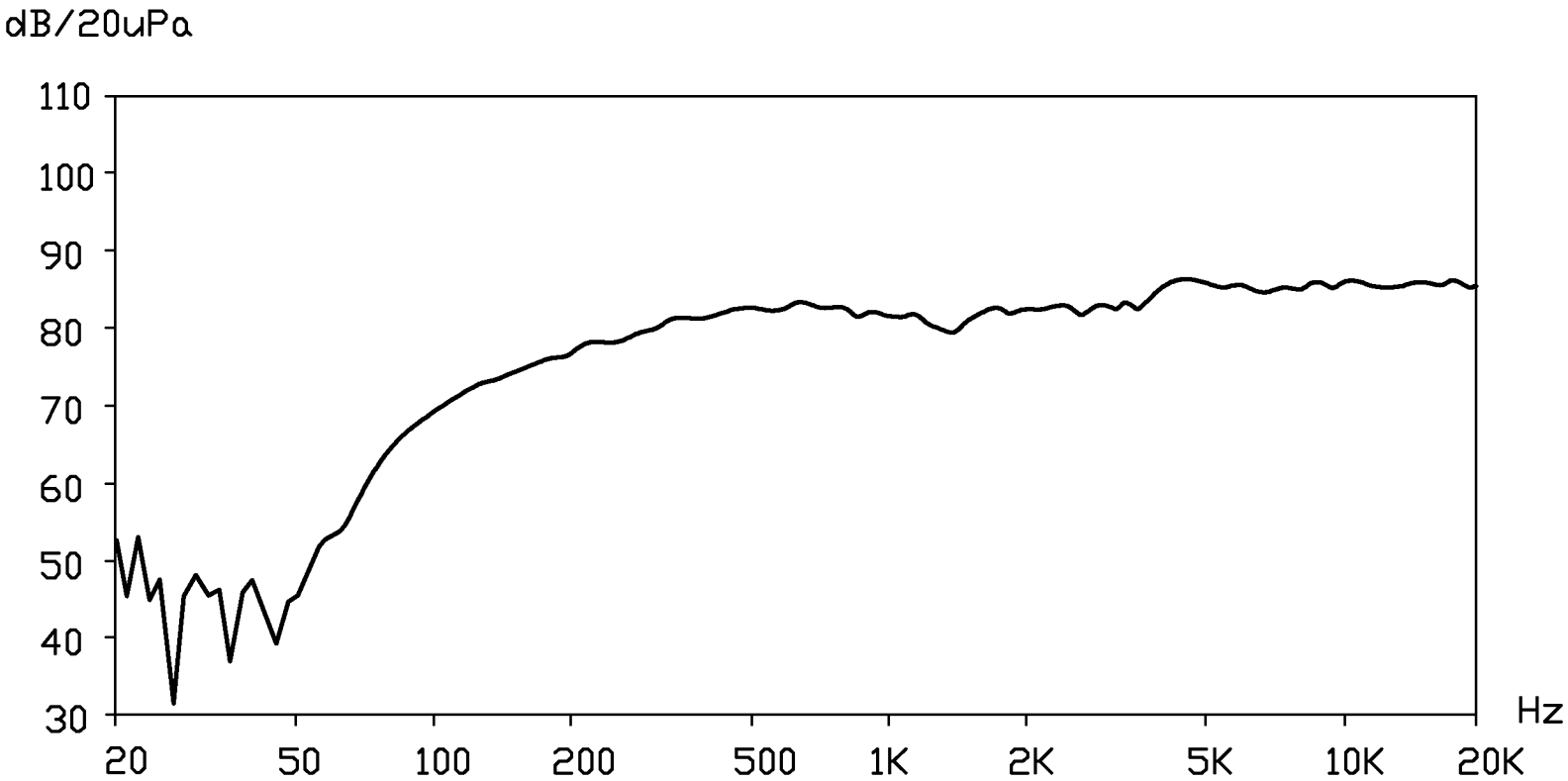
FIG. 9 is a graph showing a performance curve of sound output from the electronic device of FIG. 1.

FIG. 9 shows a performance curve of the sound output from the electronic device 500. As seen, the performance curve of the sound output from the electronic device 500 is relatively smooth, and the high frequency range of the sound is excellent.

In alternative embodiments, the locations of the tweet and middle woof outlets 1114, 1115 of the speaker sets 100, 100*a* in the electronic device 500 can be varied from the above-described conditions of the central point N of each middle woof outlet 1115 being located nearer to the central line $L_2$ of the fixing plate 1111, 1111*a* than the central point M of each tweet outlet 1114. The embodiments described below include examples of such variations. In addition, it is to be understood that each of the speaker sets 100, 100*a* can be used as a sole speaker set 100 or 100*a*.

Figure 10:
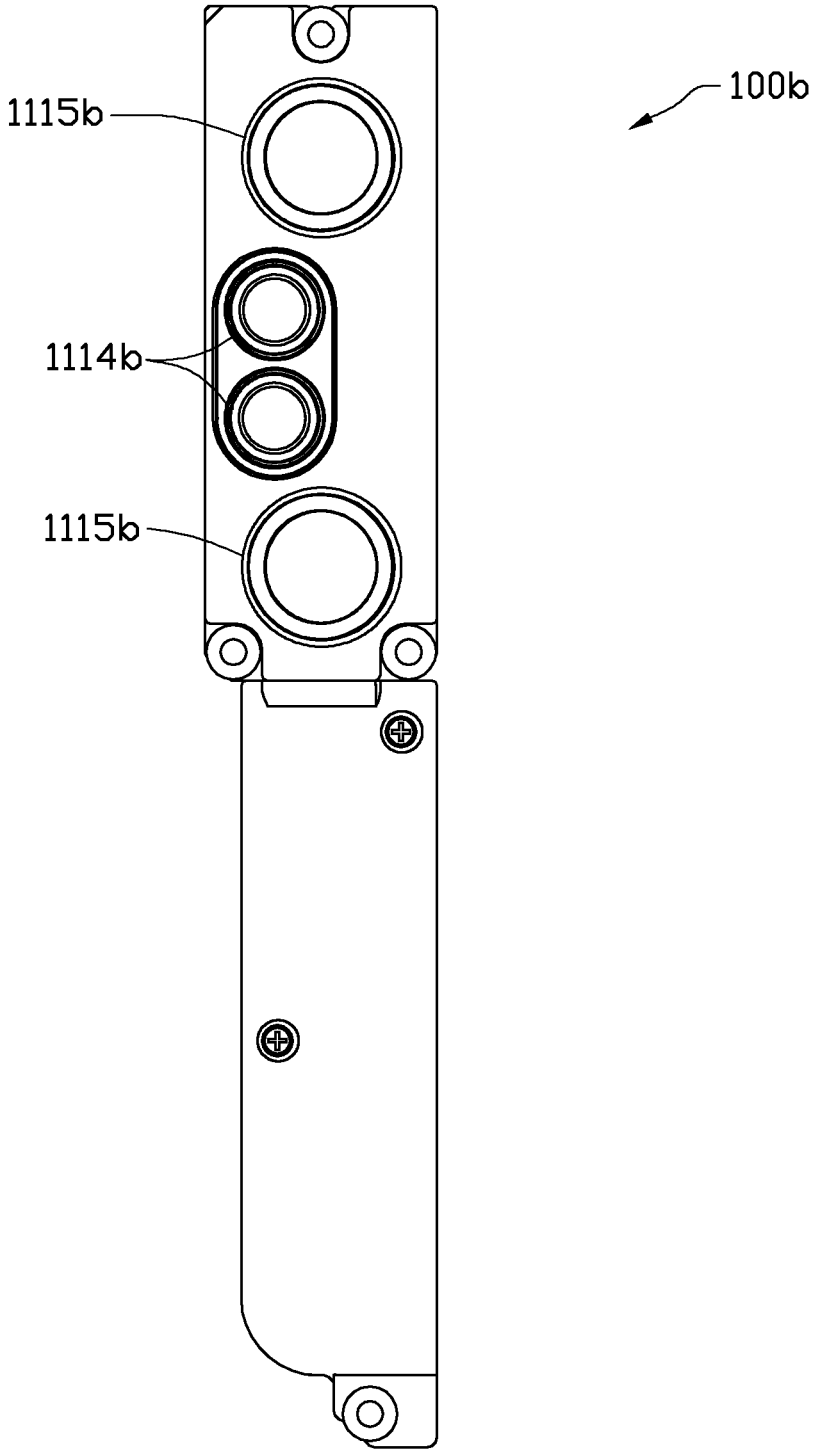
FIG. 10 is a front elevational view of a speaker set in accordance with a second embodiment of the disclosure.
Figure 11:
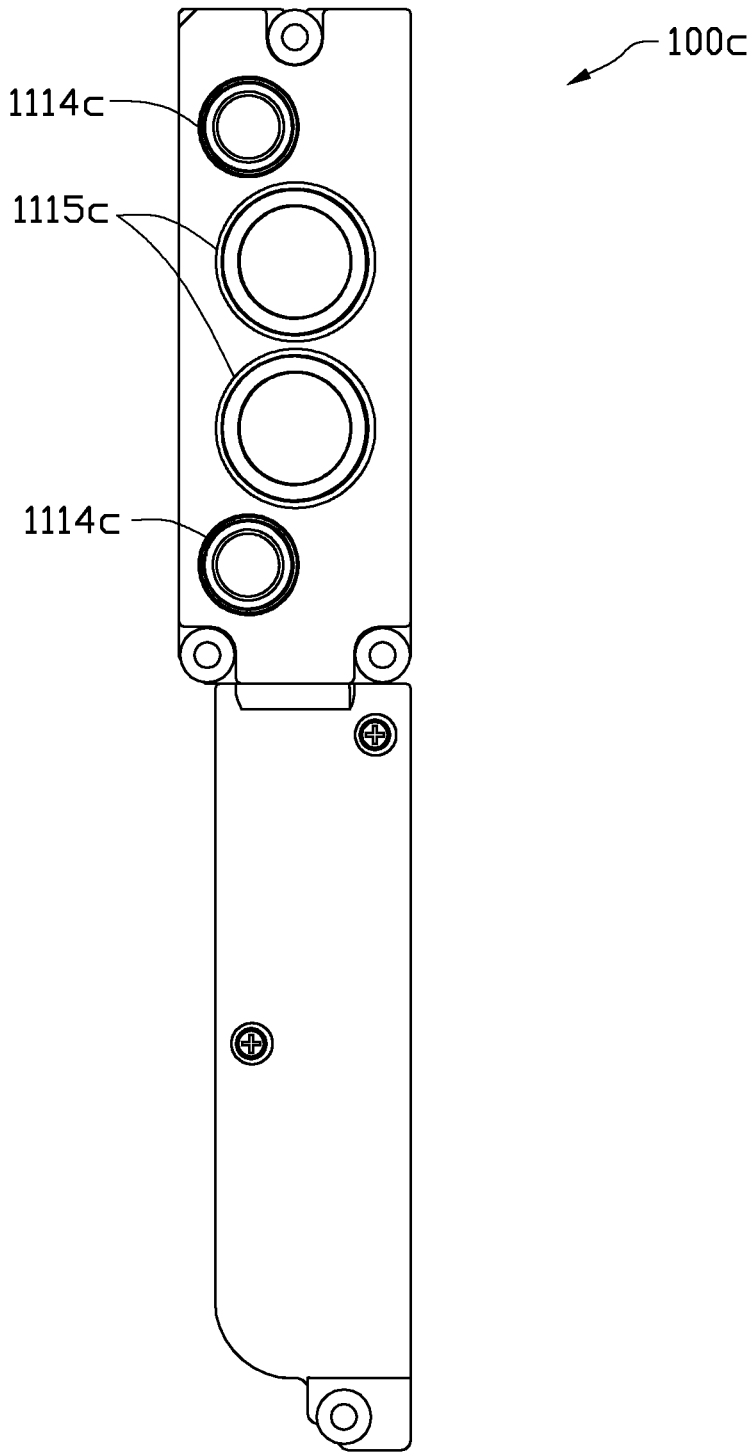
FIG. 11 is a front elevational view of a speaker set in accordance with a third embodiment of the disclosure.
Figure 12:
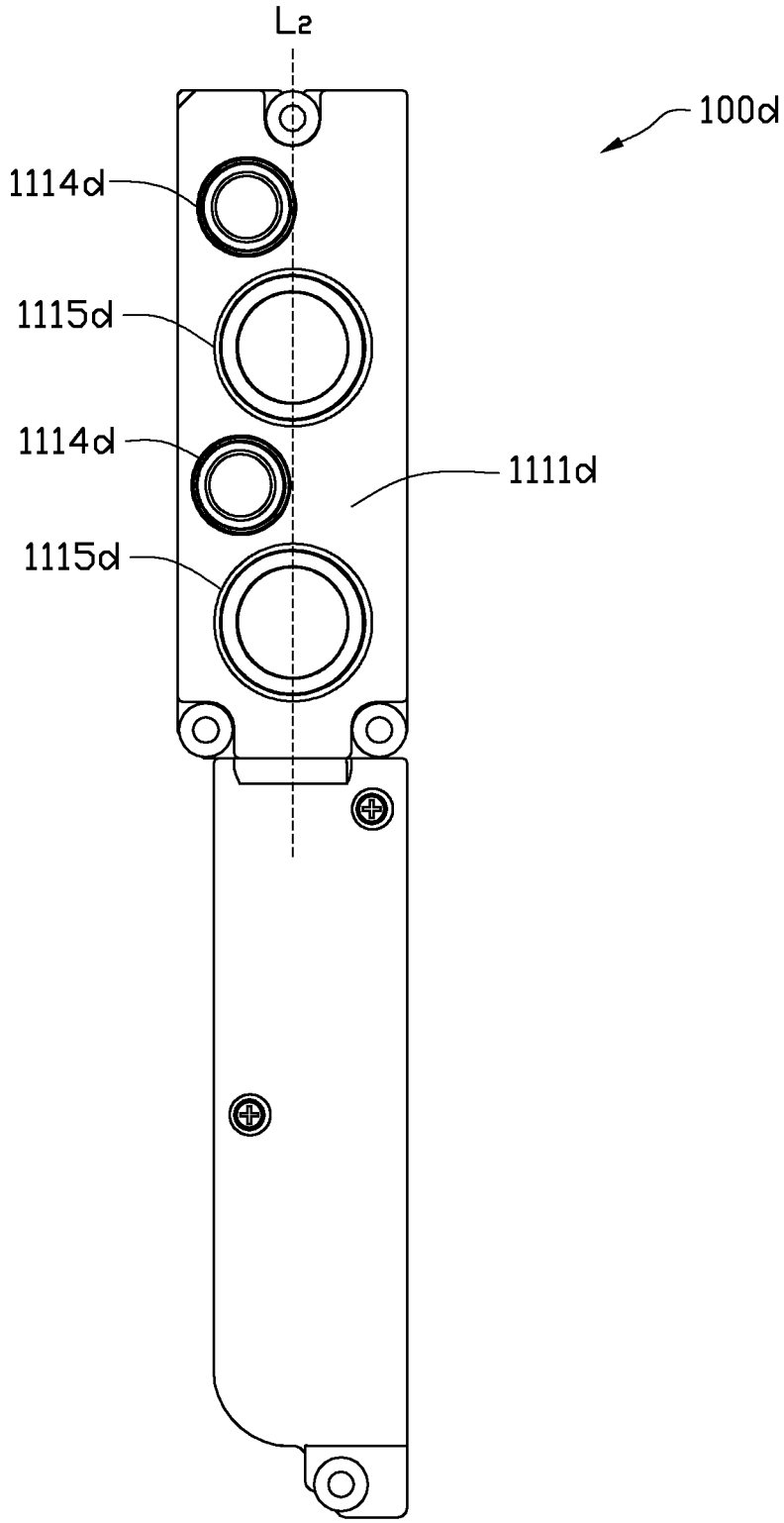
FIG. 12 is a front elevational view of a speaker set in accordance with a fourth embodiment of the disclosure.

FIG. 10 shows a speaker set 100*b* in accordance with a second embodiment of the disclosure. In this embodiment, a pair of tweet outlets 1114*b* are located between a pair of middle woof outlets 1115*b*. FIG. 11 shows a speaker set 100*c* in accordance with a third embodiment of the disclosure. In this embodiment, a pair of middle woof outlets 1115*c* are located between a pair of tweet outlets 1114*c*. FIG. 12 shows a speaker set 100*d* in accordance with a fourth embodiment of the disclosure. In this embodiment, a pair of tweet outlets 1114*d* are staggered with respect to a pair of middle woof outlets 1115*d* along the central line $L_2$ of a fixing plate 1111*d*.

In alternative embodiments, the frequency dividing circuit 40 can be a multi-branch frequency circuit, and thus divides sound into a plurality of frequency ranges. In addition, a plurality of capacitances, inductances and resistances can be connected in parallel or in series in the frequency dividing circuit 40 if and as required.

Figure 13:
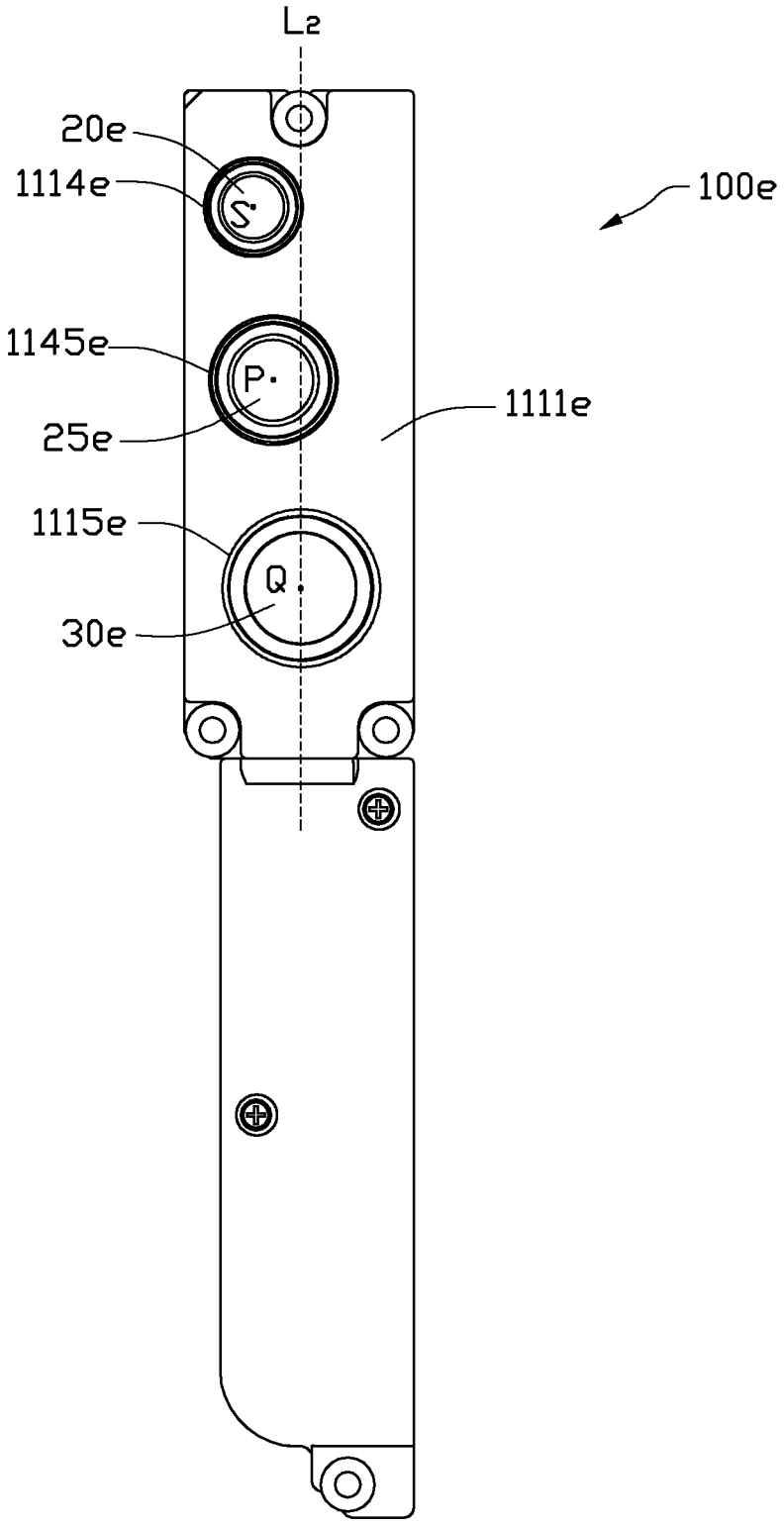
FIG. 13 is a front elevational view of a speaker set in accordance with a fifth embodiment of the disclosure.
Figure 14:
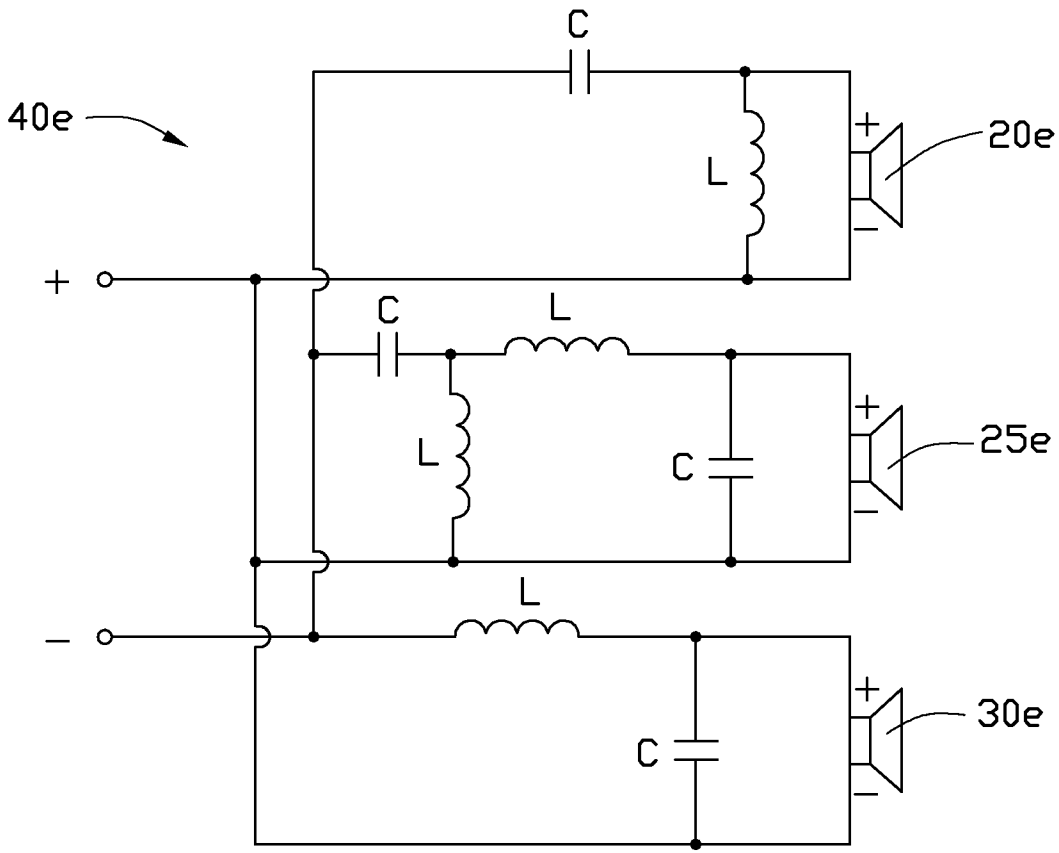
FIG. 14 is a diagram of a frequency dividing circuit of the speaker set of FIG. 13.

Referring to FIGS. 13 and 14, a speaker set 100*e* and a frequency dividing circuit 40*e* of the speaker set 100*e* in accordance with a fifth embodiment of the disclosure are shown.

In this embodiment, the frequency dividing circuit 40*e* is a triple-branch frequency circuit" or "three-branch frequency circuit, and thus divides sound into three frequency ranges, i.e., a low frequency range, a middle frequency range and a high frequency range. The speaker set 100*e* includes a tweeter 20*e*, a squawker 25*e* and a woofer 30*e* corresponding to the three frequency ranges, respectively. The tweeter 20*e*, the squawker 25*e* and the woofer 30*e* have increasing diameters in that sequence. The tweeter 20*e* mainly provides high frequency acoustic output, the squawker 25*e* mainly provides middle frequency acoustic output, and the woofer 30*e* mainly provides low frequency acoustic output. The fixing plate 1111*e* of the speaker set 100*e* defines a tweet outlet 1114*e* in which the tweeter 20*e* is mounted, a squawk outlet 1145*e* in which the squawker 25*e* is mounted, and a woofer outlet 1115*e* in which the woofer 30*e* is mounted. The tweet, squawk and woofer outlets 1114*e*, 1145*e*, 1115*e* have increasing diameters in that sequence. The central line $L_2$ of the fixing plate 1111*e* extends through a central point Q of the woofer outlet 1115*e*. A central point P of the squawk outlet 1145*e* is located nearer to the central line $L_2$ of the fixing plate 1111*e* than a central point S of the tweet outlet 1114*e*.

A plurality of capacitances C and inductances L are connected in parallel or in series in the frequency dividing circuit 40*e*. The frequency dividing circuit 40*e* includes a high-pass branch circuit electrically connecting to the tweeter 20*e*, a medium-pass branch circuit electrically connected to the squawker 25*e*, and a low-pass branch circuit electrically connected to the woofer 30*e*. The high-pass branch circuit filters middle and low frequency ranges of the sound to be output from the tweeter 20*e* as much as possible. The medium-pass branch circuit filters high and low frequency ranges of the sound to be output from the squawker 25*e* as much as possible. The low-pass branch circuit filters high and middle frequency ranges of the sound to be output from the woofer 30*e* as much as possible.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker set, comprising:

at least one first speaker providing high frequency acoustic output;

at least one second speaker providing low and middle frequency acoustic output; and a shell receiving the at least one first speaker and the at least one second speaker therein, the shell comprising a fixing plate defining at least one first sound outlet in which the at least one first speaker is mounted, and at least one second sound outlet in which the at least one second speaker is mounted, a central point of each of the at least one second sound outlet being located nearer to an imaginary central line of the fixing plate than a center of each of the at least one first sound outlet;

wherein the fixing plate is rectangular and planar, the at least one first sound outlet being spaced from the imaginary central line of the fixing plate and being adjacent to a long side of the fixing plate, the at least one second sound outlet being located on the imaginary central line of the fixing plate;

wherein the shell comprises a top cover and a bottom cover engaged with the top cover, the top cover comprising a mounting wall and a sidewall extending downwardly from an outer periphery of the mounting wall, the mounting wall comprising the fixing plate at one end thereof and an extension plate at an opposite end thereof, a resonance chamber being defined between the fixing plate, the sidewall of the top cover and the bottom cover, the at least one first speaker and the at least one second speaker being received in the resonance chamber, a sound channel being defined between the extension plate and the bottom cover, the sound channel communicating the resonance chamber with the outside of the shell, sound in the resonance chamber being transmitted out from the shell via the sound channel; and wherein the top cover further comprises a semi-enclosed sound cover, an open end of the sound cover engaging intimately with the fixing plate of the top cover to cooperatively define a receiving chamber therebetween, the at least one first speaker being received in the receiving chamber.

2. The speaker set of claim 1, wherein an imaginary line is defined as extending through the central point of any one of the at least one first sound outlet and the central point of any one of the at least one second sound outlet, and the imaginary line and the imaginary central line of the fixing plate define an acute angle therebetween.

3. The speaker set of claim 1, further comprising a dual-branch frequency circuit, wherein the at least one first speaker is a tweeter, the at least one second speaker being a middle woofer, the two divided-frequency circuit being configured for filtering middle and low frequency ranges of sound to be output from the tweeter, and filtering a high frequency range of sound to be output from the middle woofer.

4. The speaker set of claim 1, further comprising a triple-branch frequency circuit, wherein the at least one first speaker is tweeter, the at least one second speaker comprising a plurality of second speakers, the second speakers comprising a squawker and a woofer, the triple-branch frequency circuit being configured for filtering middle and low frequency ranges of sound to be output from the tweeter, filtering high and low frequency ranges of sound to be output from the squawker, and filtering high and middle frequency ranges of sound to be output from the woofer.

5. The speaker set of claim 1, wherein the at least one first speaker comprises a plurality of first speakers, and the fixing plate defines a plurality of first sound outlets aligning respectively with the first speakers, the at least one second sound outlet being located between two of the first sound outlets.

6. The speaker set of claim 1, wherein the at least one second speaker comprises a plurality of second speakers, and the fixing plate defines a plurality of second sound outlets aligning respectively with the second speakers, the at least one first sound outlet being located between two of the second sound outlets.

7. The speaker set of claim 1, wherein the at least one first speaker comprises a plurality of first speakers and the at least one second speaker comprises a plurality of second speakers, the fixing plate defining a plurality of first sound outlets aligning respectively with the first speakers, and a plurality of second sound outlets aligning respectively with the second speakers, the first sound outlets being staggered with respect to the second sound outlets in a direction parallel to the imaginary central line of the fixing plate.

8. The speaker set of claim 1, wherein the at least one first speaker comprises a plurality of first speakers and the at least one second speaker comprises a plurality of second speakers, the fixing plate defining a plurality first sound outlets aligning respectively with the first speakers, and a plurality second sound outlets aligning respectively with the second speakers, the first sound outlets being adjacent to each other, and the second sound outlets being adjacent to each other.

9. The speaker set of claim 1, wherein the at least one first speaker comprises a plurality of first speakers and the at least one second speaker comprises a plurality of second speakers, the fixing plate defining a plurality of first sound outlets aligning respectively with the first speakers, and a plurality of second sound outlets aligning respectively with the second speakers, an imaginary line being defined through central points of the first sound outlets, an imaginary line being defined through central points of the second sound outlets, the two imaginary lines being parallel to each other.

10. The speaker set of claim 1, wherein the sound cover defines a tuning hole therein in communication with the receiving chamber and the resonance chamber, a tuning cloth being attached over the tuning hole.

11. A speaker set, comprising:

at least one first speaker providing high frequency acoustic output;

at least one second speaker providing low and middle frequency acoustic output; and a shell receiving the at least one first speaker and the at least one second speaker therein, the shell comprising a fixing plate defining at least one first sound outlet in which the at least one first speaker is mounted, and at least one second sound outlet in which the at least one second speaker is mounted, a central point of each of the at least one second sound outlet being located nearer to an imaginary central line of the fixing plate than a center of each of the at least one first sound outlet;

wherein the shell comprises a top cover and a bottom cover engaged with the top cover, the top cover comprising a mounting wall and a sidewall extending downwardly from an outer periphery of the mounting wall, the mounting wall comprising the fixing plate at one end thereof and an extension plate at an opposite end thereof, a resonance chamber being defined between the fixing plate, the sidewall of the top cover and the bottom cover, the at least one first speaker and the at least one second speaker being received in the resonance chamber, a sound channel being defined between the extension plate and the bottom cover, the sound channel communicating the resonance chamber with an outside of the shell, sound in the resonance chamber being transmitted out from the shell via the sound channel; and wherein the top cover further comprises a semi-enclosed sound cover, an open end of the sound cover engaging intimately with the fixing plate of the top cover to cooperatively define a receiving chamber therebetween, the at least one first speaker being received in the receiving chamber.

12. The speaker set of claim 11, wherein an imaginary line is defined as extending through the central point of any one of the at least one first sound outlet and the central point of any one of the at least one second sound outlet, and the imaginary line and the imaginary central line of the fixing plate define an acute angle therebetween.

13. The speaker set of claim 11, further comprising a dual-branch frequency circuit, wherein the at least one first speaker is a tweeter, the at least one second speaker being a middle woofer, the two divided-frequency circuit being configured for filtering middle and low frequency ranges of sound to be output from the tweeter, and filtering a high frequency range of sound to be output from the middle woofer.

14. The speaker set of claim 11, further comprising a triple-branch frequency circuit, wherein the at least one first speaker is tweeter, the at least one second speaker comprising a plurality of second speakers, the second speakers comprising a squawker and a woofer, the triple-branch frequency circuit being configured for filtering middle and low frequency ranges of sound to be output from the tweeter, filtering high and low frequency ranges of sound to be output from the squawker, and filtering high and middle frequency ranges of sound to be output from the woofer.

15. The speaker set of claim 11, wherein the at least one first speaker comprises a plurality of first speakers, and the fixing plate defines a plurality of first sound outlets aligning respectively with the first speakers, the at least one second sound outlet being located between two of the first sound outlets.

16. The speaker set of claim 11, wherein the at least one second speaker comprises a plurality of second speakers, and the fixing plate defines a plurality of second sound outlets aligning respectively with the second speakers, the at least one first sound outlet being located between two of the second sound outlets.

17. The speaker set of claim 11, wherein the at least one first speaker comprises a plurality of first speakers and the at least one second speaker comprises a plurality of second speakers, the fixing plate defining a plurality of first sound outlets aligning respectively with the first speakers, and a plurality of second sound outlets aligning respectively with the second speakers, the first sound outlets being staggered with respect to the second sound outlets in a direction parallel to the imaginary central line of the fixing plate.

18. The speaker set of claim 11, wherein the at least one first speaker comprises a plurality of first speakers and the at least one second speaker comprises a plurality of second speakers, the fixing plate defining a plurality first sound outlets aligning respectively with the first speakers, and a plurality second sound outlets aligning respectively with the second speakers, the first sound outlets being adjacent to each other, and the second sound outlets being adjacent to each other.

19. The speaker set of claim 11, wherein the at least one first speaker comprises a plurality of first speakers and the at least one second speaker comprises a plurality of second speakers, the fixing plate defining a plurality of first sound outlets aligning respectively with the first speakers, and a plurality of second sound outlets aligning respectively with the second speakers, an imaginary line being defined through central points of the first sound outlets, an imaginary line being defined through central points of the second sound outlets, the two imaginary lines being parallel to each other.

* * * * *